US009383664B2

(12) United States Patent
Okada

(10) Patent No.: US 9,383,664 B2
(45) Date of Patent: Jul. 5, 2016

(54) ELECTROPHOTOGRAPHIC PHOTOSENSITIVE MEMBER

(71) Applicant: KYOCERA Document Solutions Inc., Osaka (JP)

(72) Inventor: Hideki Okada, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/522,782

(22) Filed: Oct. 24, 2014

(65) Prior Publication Data

US 2015/0118607 A1 Apr. 30, 2015

(30) Foreign Application Priority Data

Oct. 30, 2013 (JP) ..... 2013-225079

(51) Int. Cl.
*G03G 5/00* (2006.01)
*G03G 5/06* (2006.01)

(52) U.S. Cl.
CPC ..... *G03G 5/0651* (2013.01); *G03G 5/065* (2013.01); *G03G 5/0629* (2013.01); *G03G 5/0659* (2013.01)

(58) Field of Classification Search
CPC . G03G 5/0651; G03G 5/0629; G03G 5/0659; G03G 5/065
USPC ..... 430/58.5, 58.85, 73, 78
See application file for complete search history.

(56) References Cited

U.S. PATENT DOCUMENTS

| | | | |
|---|---|---|---|
| 7,291,429 | B2 | 11/2007 | Kim et al. |
| 2005/0112482 | A1 | 5/2005 | Kim et al. |
| 2014/0231773 | A1 | 8/2014 | Suraru et al. |

FOREIGN PATENT DOCUMENTS

| | | | |
|---|---|---|---|
| JP | 2005-154444 | A | 6/2005 |
| WO | 2013/024409 | A1 | 2/2013 |

OTHER PUBLICATIONS

The extended European search report issued by the European Patent Office on Mar. 9, 2015, which corresponds to European Patent Application No. 14190653.7-1303 and is related to U.S. Appl. No. 14/522,782.

Jing Gao, et al.; "Synthesis and Properties of Naphthobisbenzothiophene Diimides"; XP-002736320; Organic Letters; Feb. 28, 2013; pp. 1366-1369; vol. 15, No. 6; Amerian Chemical Society.

*Primary Examiner* — Thorl Chea
(74) *Attorney, Agent, or Firm* — Studebaker & Brackett PC

(57) ABSTRACT

An electrophotographic photosensitive member includes a photosensitive layer containing a naphthalenediimide derivative represented by the following formula (1) or (2). In the formula (1) or (2), $R_1$ represents an alkyl group having 1 to 10 carbon atoms, an aryl group having 6 to 12 carbon atoms and optionally having an alkyl group having 1 to 10 carbon atoms, an aralkyl group having 7 to 12 carbon atoms, a cycloalkyl group having 3 to 10 carbon atoms, or an alkoxy group having 1 to 6 carbon atoms.

(1)

(2)

5 Claims, 1 Drawing Sheet

ELECTROPHOTOGRAPHIC PHOTOSENSITIVE MEMBER

INCORPORATION BY REFERENCE

The present application claims priority under 35 U.S.C. §119 to Japanese Patent Application No.2013-225079, filed Oct. 30, 2013. The contents of this application are incorporated herein by reference in their entirety.

BACKGROUND

The present disclosure relates to electrophotographic photosensitive members.

As an electrophotographic photosensitive member included in an image forming apparatus or the like, there has been known an organic photosensitive member containing: a binder resin; a charge generating material; a hole transport material and an electron transport material as charge transport materials; and so on. Such an organic photosensitive member is advantageous in that it can be produced more easily and have higher degree of freedom in structural design as having more options for materials of the photosensitive member as compared with an inorganic photosensitive member including an inorganic material such as amorphous silicon.

In order for an image forming apparatus including an organic photosensitive member as an electrophotographic photosensitive member to form high-quality images, there is a strong need for materials of the organic photosensitive member to have sufficient photosensitivity.

In general, it is difficult for the electron transport material used in the organic photosensitive member, among the materials contained in the organic photosensitive member, to show sufficient photosensitivity. Accordingly, various electron transport materials capable of enhancing the photosensitivity of the organic photosensitive member have been investigated.

SUMMARY

An electrophotographic photosensitive member of the present disclosure includes a photosensitive layer containing a naphthalenediimide derivative represented by the following formula (1) or (2).

(1)

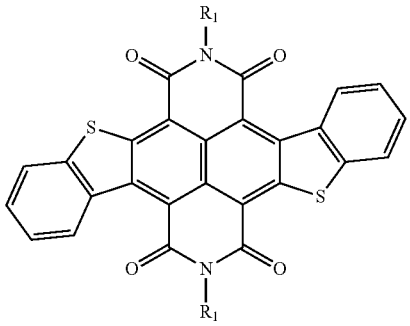

-continued (2)

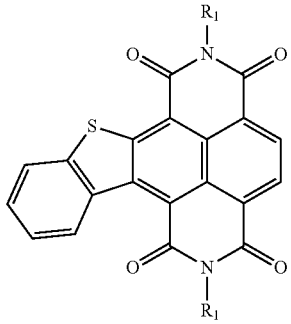

In the formula (1) or (2), $R_1$ represents an alkyl group having 1 to 10 carbon atoms, an aryl group having 6 to 12 carbon atoms and optionally having an alkyl group having 1 to 10 carbon atoms, an aralkyl group having 7 to 12 carbon atoms, a cycloalkyl group having 3 to 10 carbon atoms, or an alkoxy group having 1 to 6 carbon atoms.

DETAILED DESCRIPTION

Figure 1A:
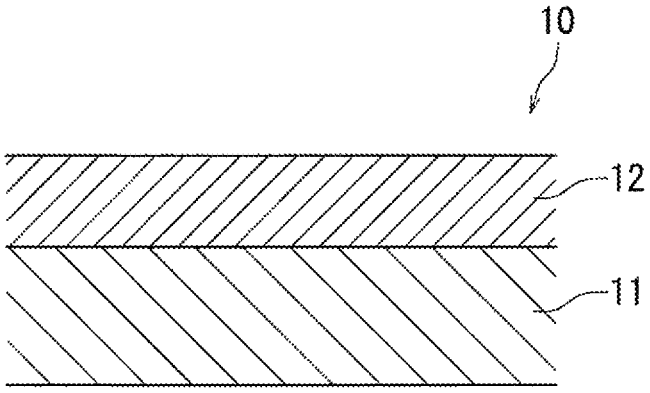
FIG. 1A is a schematic cross sectional view showing a structure of an electrophotographic photosensitive member of the present disclosure.

Hereinafter, the present disclosure will be described in detail. The present disclosure is not limited to the description.

[Naphthalenediimide Derivative]

An electrophotographic photosensitive member according to an embodiment of the present disclosure contains a specified naphthalenediimide derivative. The naphthalenediimide derivative can function to enhance the electron mobility in the electrophotographic photosensitive member. Specifically, the naphthalenediimide derivative is represented by the following formula (1) or (2).

(1)

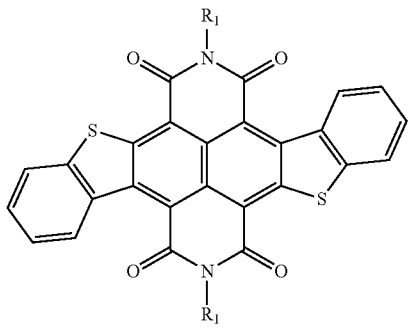

-continued (2)

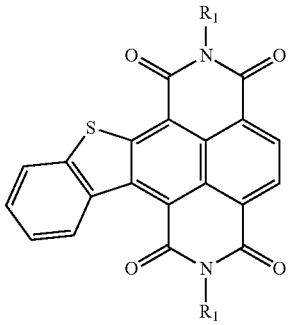

In the formula (1) or (2), $R_1$ represents an alkyl group having 1 to 10 carbon atoms, an aryl group having 6 to 12 carbon atoms and optionally having an alkyl group having 1 to 10 carbon atoms, an aralkyl group having 7 to 12 carbon atoms, a cycloalkyl group having 3 to 10 carbon atoms, or an alkoxy group having 1 to 6 carbon atoms.

Because of the enhanced electron mobility, the electrophotographic photosensitive member containing the specified naphthalenediimide derivative can have excellent photosensitivity. The photosensitivity will be described in detail in examples.

Examples of the alkyl group having 1 to 10 carbon atoms represented by $R_1$ include methyl group, ethyl group, isopropyl group, t-butyl group, pentyl group, hexyl group, heptyl group, octyl group, nonyl group, and decyl group. Of the alkyl group having 1 to 10 carbon atoms, an alkyl group having more carbon atoms is preferably used. This is because when an electrophotographic photosensitive member contains a naphthalenediimide derivative having such an alkyl group as $R_1$, the possibility of the occurrence of crystallization on a surface of the photosensitive member during formation of the photosensitive layer can be reduced. In this view, the alkyl group having 1 to 10 carbon atoms represented by $R_1$ is preferably an alkyl group having 3 to 10 carbon atoms, more preferably an alkyl group having 5 to 10 carbon atoms, particularly preferably an alkyl group having 7 to 10 carbon atoms, and most preferably an octyl group.

Examples of the aryl group having 6 to 12 carbon atoms represented by $R_1$ include phenyl group, naphthyl group, and biphenyl group. In particular, phenyl group is preferable. The aryl group may optionally have an alkyl group having 1 to 10 carbon atoms. Examples of the alkyl group having 1 to 10 carbon atoms as a substituent include the groups mentioned as examples of the alkyl group having 1 to 10 carbon atoms represented by $R_1$. The alkyl group having 1 to 10 carbon atoms as the substituent is preferably an alkyl group having 1 to 5 carbon atoms, more preferably an alkyl group having 1 to 3 carbon atoms, and particularly preferably an i-propyl group (isopropyl group). When the aryl group having 6 to 12 carbon atoms has the alkyl group having 1 to 10 carbon atoms as the substituent, the number of alkyl groups is not particularly limited. For example, the number of alkyl groups is 1 to 3, and preferably 2. The substitution position of the alkyl group having 1 to 10 carbon atoms that may be in the aryl group having 6 to 12 carbon atoms is not particularly limited. For example, the substitution position is ortho position. Examples of the aryl group having 6 to 12 carbon atoms and optionally having an alkyl group having 1 to 10 carbon atoms include tolyl group (specifically, o-, m-, or p-tolyl group), cumenyl group (specifically, o-, m-, or p-cumenyl group), xylyl group (specifically, 2,3-xylyl group, 2,4-xylyl group, 2,5-xylyl group, 2,6-xylyl group, 3,4-xylyl group, or 3,5-xylyl group), mesityl group, diisopropylphenyl group (specifically, 2,3-diisopropylphenyl group, 2,4-diisopropylphenyl group, 2,5-diisopropylphenyl group, 2,6-diisopropylphenyl group, 3,4-diisopropylphenyl group, or 3,5-diisopropylphenyl group), and triisopropylphenyl group. In particular, diisopropylphenyl group is preferable, and 2,6-diisopropylphenyl group is more preferable.

The aralkyl group having 7 to 12 carbon atoms represented by $R_1$ include benzil group and phenethyl group.

Examples of the cycloalkyl group having 3 to 10 carbon atoms represented by $R_1$ include cyclopropyl group, cyclobutyl group, cyclopentyl group, cyclohexyl group, cycloheptyl group, cyclooctyl group, cyclononyl group, and cyclodecyl group.

Examples of the alkoxy group having 1 to 6 carbon atoms represented by $R_1$ include methoxy group, ethoxy group, propoxy group, butoxy group, pentoxy group, and hexoxy group.

Of the above-mentioned groups, $R_1$ is preferably an alkyl group having 1 to 10 carbon atoms or an aryl group having 6 to 12 carbon atoms and optionally having an alkyl group having 1 to 10 carbon atoms from a standpoint of the photosensitivity and from a standpoint of the compatibility with the later-described binder resin. More preferably, $R_1$ is octyl group or diisopropylphenyl group.

Particularly preferably, the naphthalenediimide derivative is the one represented by the formula (1), wherein $R_1$ is octyl group or diisopropylphenyl group from a standpoint of the photosensitivity and from a standpoint of the compatibility with the later-described binder resin.

The naphthalenediimide derivative represented by the general formula (1) or (2) can be synthesized in accordance with a scheme 1 or 2.

[Scheme 1]

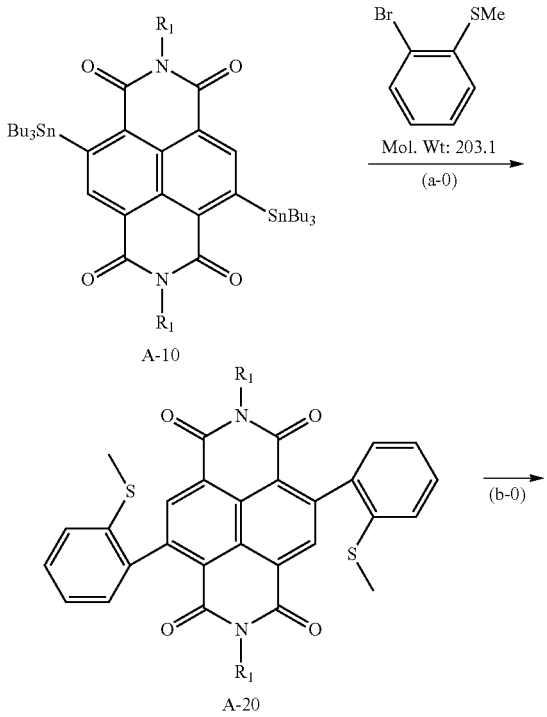

-continued

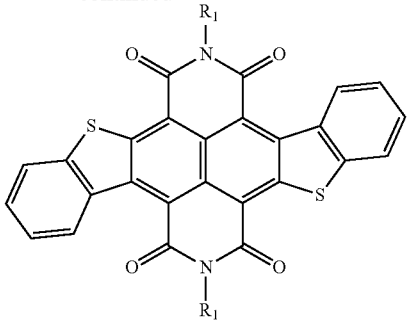

1-0

[Scheme 2]

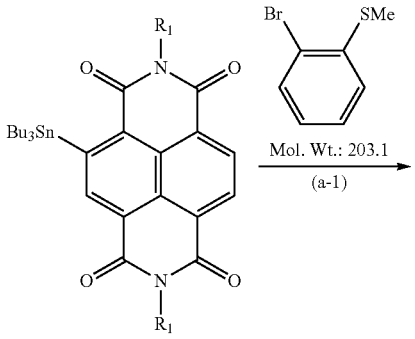

A-11

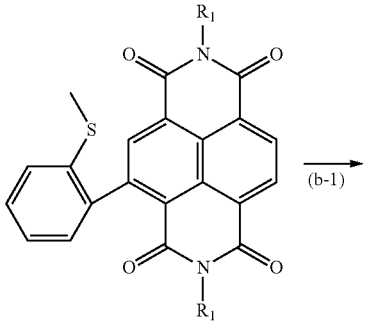

A-21

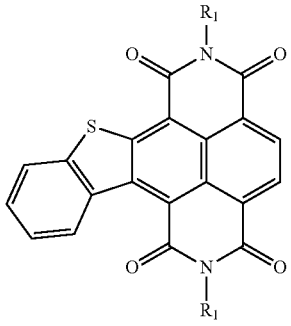

1-1

In the scheme 1 or 2, $R_1$ represents an alkyl group having 1 to 10 carbon atoms, an aryl group having 6 to 12 carbon atoms and optionally having an alkyl group having 1 to 10 carbon atoms, an aralkyl group having 7 to 12 carbon atoms, a cycloalkyl group having 3 to 10 carbon atoms, or an alkoxy group having 1 to 6 carbon atoms.

[Electrophotographic Photosensitive Member]

The electrophotographic photosensitive member of the present disclosure contains the naphthalenediimide derivative represented by the general formula (1) or (2). Since the electrophotographic photosensitive member of the present disclosure has enhanced photosensitivity, an image forming apparatus including such an electrophotographic photosensitive member can form high-quality images. In particular, the electrophotographic photosensitive member of the present disclosure can be understood as an electrophotographic photosensitive member including a conductive substrate and a photosensitive layer containing the naphthalenediimide derivative.

The electrophotographic photosensitive member of the present disclosure may be a single-layer photosensitive member or a multi-layer photosensitive member. A charge generating material, a hole transport material, an electron transport material, and a binder resin are contained in a single layer (photosensitive layer) in the single-layer photosensitive member. A charge generating layer and a charge transport layer are laminated to a conductive substrate in the multi-layer photosensitive member. The charge generating layer contains a charge generating material and a base resin (binder resin for charge generating layer). The charge transport layer contains an electron transport material, a hole transport material, and a binder resin. In the multi-layer photosensitive member, the electron transport material may act as an electron acceptor compound for increasing the efficiency of charge generation in the charge generating layer.

The photosensitive layer of the single-layer photosensitive member has a simpler structure and is more easily produced than that of the multi-layer photosensitive member. By contrast, at least two layers need to be formed for producing the multi-layer photosensitive member, and therefore the production process thereof can be laborious. Furthermore, the single-layer photosensitive member can allow formation of high-quality images and reduction of the possibility of the occurrence of a film defect.

In the multi-layer photosensitive member, the charge generating layer and the charge transport layer are each thinner than the photosensitive layer of the single-layer photosensitive member. Accordingly, the charge generating layer and the charge transport layer are vulnerable to damage. In particular, the charge generating layer is extremely thin, and therefore the performance of the electrophotographic photosensitive member may be lowered. In many cases, the photosensitive layer of the single-layer photosensitive member is thicker than the charge generating layer or the charge transport layer of the multi-layer photosensitive member. Accordingly, the photosensitive layer of the single-layer photosensitive member is less likely to be damaged completely. Thus, in the case of the single-layer photosensitive member, the possibility of the occurrence of a film defect in the photosensitive member can be reduced.

Hereinafter, an example of the electrophotographic photosensitive member of the present disclosure will be described with reference to FIGS. 1A and 1B. An electrophotographic photosensitive member 10 includes a conductive substrate 11 and a photosensitive layer 12. The photosensitive layer 12 is disposed on the conductive substrate 11. Preferably, the photosensitive layer 12 contains the naphthalenediimide derivative represented by the general formula (1) or (2) as an electron transport material, a charge generating material, a hole transport material, and a binder resin in a single layer. For example, the photosensitive layer 12 may be disposed directly on the conductive substrate 11 as shown in FIG. 1A. In addition, the photosensitive layer 12 may be exposed as an outermost layer as shown in FIG. 1A.

Figure 1B:
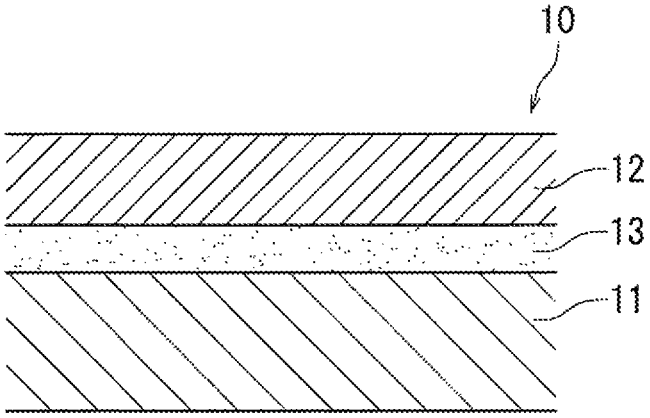
FIG. 1B is a schematic cross sectional view showing another structure of the electrophotographic photosensitive member of the present disclosure.

Alternatively, the electrophotographic photosensitive member 10 may be provided with an intermediate layer 13 between the conductive substrate 11 and the photosensitive layer 12 as shown in FIG. 1B as long as the properties of the electrophotographic photosensitive member 10 are not impaired.

[Conductive Substrate]

Various conductive materials can be used for the conductive substrate 11. Specific examples thereof include metals (e.g., iron, aluminum, copper, tin, platinum, silver, vanadium, molybdenum, chromium, cadmium, titanium, nickel, palladium, indium, stainless steel and/or brass); plastic materials prepared by depositing or laminating the above-mentioned metal thereto; and glass coated with aluminum iodide, tin oxide, and/or indium oxide.

The conductive substrate 11 may take the form of a sheet or a drum depending on the structure of the image forming apparatus in which the conductive substrate 11 is used. The entire conductive substrate 11 may have conductivity or only a surface of the conductive substrate 11 may have conductivity. Preferably, the conductive substrate 11 shows sufficient mechanical strength in use.

[Photosensitive Layer]

The photosensitive layer 12 may contain the naphthalenediimide derivative represented by the general formula (1) or (2), a charge generating material, a hole transport material, and a binder resin. The naphthalenediimide derivative represented by the general for a (1) or (2) contained in the photosensitive layer 12 acts as an electron transport material, which is one of charge transport materials.

The electrophotographic photosensitive member 10 of the present disclosure contains the naphthalenediimide derivative represented by the general formula (1) or (2), and the naphthalenediimide derivative can act as an electron transport material.

<Electron Transport Material>

The electrophotographic photosensitive member 10 may contain only the naphthalenediimide derivative represented by the general formula (1) or (2) as an electron transport material. Alternatively, the electrophotographic photosensitive member 10 may contain an additional electron transport material in combination with the naphthalenediimide derivative.

Examples of the additional electron transport material that may be contained in combination with the naphthalenediimide derivative represented by the general formula (1) or (2) include naphthoquinone derivatives, anthraquinone derivatives, malononitrile derivatives, thiopyran derivatives, trinitrothioxanthone derivatives, 3,4,5,7-tetranitro-9-fluorenone derivatives, dinitroanthracene derivatives, dinitroacridine derivatives, nitroanthraquinone derivatives, dinitroanthraquinone derivatives, tetracyanoethylene, 2,4,8-trinitrothioxanthone, dinitrobenzene, dinitroanthracene, dinitroacridine, nitroanthraquinone, dinitroanthraquinone, succinic anhydride, maleic anhydride, and dibromomaleic anhydride.

<Charge Generating Material>

The charge generating material is particularly limited as long as it can be used as a charge generating material in the electrophotographic photosensitive member 10. Specific examples thereof include powders of organic photoconductive materials (e.g., X-form metal-free phthalocyanine (x-$H_2$Pc), Y-form titanyl phthalocyanine (Y—TiOpc), perylene pigments, bisazo pigments, dithioketopyrrolopyrrole pigments, metal-free naphthalocyanine pigments, metal naphthalocyanine pigments, squaraine pigments, tris-azo pigments, indigo pigments, azulenium pigments, cyanine pigments, pyrylium salts, anthanthrone based pigments, triphenylmethane based pigments, threne based pigments, toluidine based pigments, pyrazoline based pigments, or quinacridone based pigments); and powders of inorganic photoconductive materials (e.g., selenium, selenium-tellurium, selenium-arsenic, cadmium sulfide, or amorphous silicon). The charge generating material is selected as appropriate so as to give an absorption wavelength in a desired range. These charge generating materials may be used independently, or two or more of the charge generating materials may be used in combination.

In particular, a photosensitive member having sensitivity in a wavelength range of 700 nm or longer is preferable in image forming apparatuses employing a digital optical system (e.g., laser beam printers including a semiconductor laser or the like as a light source and facsimile machine Of the above-mentioned charge generating materials, therefore, phthalocyanine-based pigments (metal-free phthalocyanine such as X-form metal-free phthalocyanine or Y-form titanyl phthalocyanine) are preferably used, for example, for such image forming apparatuses. The crystal form of the phthalocyanine-based pigments is not particularly limited, and α- or β-phthalocyanine-based pigments may be used, for example.

When the image forming apparatus includes a short-wavelength laser light source that emits light having a wavelength of 350 nm or longer and 550 nm or shorter, an anthanthrone-based pigment or a perylene-based pigment is preferably used as the charge generating material, for example.

<Hole Transport Material>

The hole transport material is not particularly limited as long as it can be used as a hole transport material in the photosensitive layer 12 of the electrophotographic photosensitive member 10. Examples of the hole transport material include nitrogen containing cyclic compounds and condensed polycyclic compounds. Examples of the nitrogen containing cyclic compounds and the condensed polycyclic compounds include diamine derivatives such as N,N,N',N'-tetraphenylbenzidine derivatives, N,N,N',N'-tetraphenylphenylenediamine derivatives, N,N,N',N'-tetraphenylnaphtylenediamine derivatives, and N,N,N',N'-tetraphenylphenanthrylenediamine derivatives; oxadiazole-based compounds such as 2,5-di(4-methylaminophenyl)-1,3,4-oxadiazole; styryl-based compounds such as 9-(4-diethylaminostyryl)anthracene; carbazole based compounds such as polyvinyl carbazole; organopolysilane compounds; pyrazoline-based compounds such as 1-phenyl-3-(p-dimethylaminophenyl)pyrazoline; hydrazone-based compounds; indole-based compounds; oxazole-based compounds; isoxazole-based compounds; thiazole-based compounds; thiadiazole-based compounds; imidazole-based compounds; pyrazole-based compounds; and triazole-based compounds. Specific examples of the N,N,N',N'-tetraphenylbenzidine derivatives include a derivative represented by the following formula (HTM-1).

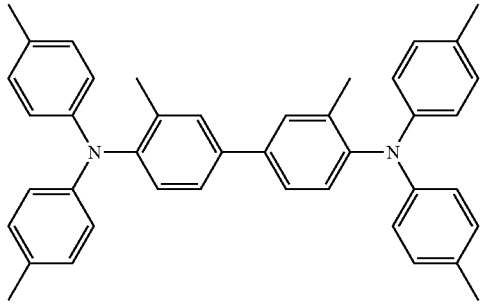

HTM-1

These hole transport materials may be used independently, or two or more of these hole transport materials may be used in combination. When a hole transport material having film forming capability (e.g., polyvinyl carbazole) is used, the material plays both a role of the hole transport material and a role of the binder resin. In this case, therefore, a binder resin is not necessarily required.

<Binder Resin>

The binder resin is used for dispersing therein the above-described components. Various resins that are usable for the photosensitive layers can be used as the binder resin. Examples of the usable binder resins include thermoplastic resins (specifically, styrene-butadiene copolymers, styrene-acrylonitrile copolymers, styrene-maleic acid copolymers, acrylic copolymers, styrene-acrylic acid copolymers, polyethylene, ethylene-vinyl acetate copolymers, chlorinated polyethylene, polyvinyl chloride, polypropylene, ionomer, vinyl chloride-vinyl acetate copolymers, alkyd resins, polyamide resins, polyurethane resins, polycarbonate resins, polyarylate resins, polysulfone resins, diallyl phthalate resins, ketone resins, polyvinyl butyral resins, polyether resins, or polyester resins); cross-linkable thermosetting resins (specifically, silicone resins, epoxy resins, phenolic resins, urea resins, or melamine resins); and photocurable resins (specifically, epoxy acrylate or urethane acrylate).

When the electrophotographic photosensitive member of the present embodiment is a multi-layer photosensitive member, the charge generating layer of the multi-layer photosensitive member contains a base resin (binder resin for charge generating layer). The base resin is not particularly limited as long as it is a resin for charge generating layers of multi-layer photosensitive members. Examples of the base resin include the resins mentioned above as examples of the binder resin. Typically, a charge generating layer and a charge transport layer are formed in a multi-layer photosensitive member. Preferably, therefore, a resin different from the binder resin contained in the charge transport layer is used as the base resin in order to prevent the base resin from being dissolved in the solvent of an liquid applied for forming the charge transport layer.

<Additive>

The electrophotographic photosensitive member 10 of the present disclosure may contain, as needed, various known additives within a range not impairing the effect of the present disclosure. Examples of the additives include antidegradants, softeners, plasticizers, surface modifiers, extenders, thickeners, dispersion stabilizers, waxes, acceptors, and donors. Examples of the antidegradants include antioxidants, radical scavengers, singlet quenchers, and ultraviolet absorbing agents. In order to enhance the photosensitivity of the photosensitive layer 12, a known sensitizer (e.g., terphenyl, halonaphthoquinones, or acenaphthylene) may be used in combination with the charge generating material.

The contents of the naphthalenediimide derivative represented by the general formula (1) or (2), the charge generating material, the hole transport material, and the binder resin in the electrophotographic photosensitive member 10 of the present disclosure are not particularly limited and can be determined as appropriate. Specifically, the content of the naphthalenediimide derivative is preferably 5 parts by mass or more and 100 or less, and more preferably 10 parts by mass or more and 80 parts by mass or less relative to 100 parts by mass of the binder resin. When the content of the naphthalenediimide derivative is 5 parts by mass or more, desired photosensitivity is sufficiently produced. When the content of the naphthalenediimide derivative is 100 parts by mass or less, the photosensitivity does not become saturated, providing a cost advantage.

The content of the charge generating material is preferably 0.1 parts by mass or more and 50 parts by mass or less, and more preferably 0.5 parts by mass or more and 30 parts by mass or less relative to 100 parts by mass of the binder resin. When the content of the charge generating material is 0.1 parts by mass or more, desired photosensitivity is sufficiently produced. When the content of the charge generating material is 50 parts by mass or less, the photosensitivity does not become saturated, providing a cost advantage.

The content of the hole transport material is preferably 5 parts by mass or more and 500 parts by mass or less, and more preferably 25 parts by mass or more and 200 parts by mass or less relative to 100 parts by mass of the binder resin. When the content of the hole transport material is 5 parts by mass or more, desired photosensitivity is sufficiently produced. When the content of the hole transport material is 500 parts by mass or less, the photosensitivity does not become saturated, providing a cost advantage.

The thickness of the photosensitive layer 12 of the electrophotographic photosensitive member 10 is not particularly limited as long as the photosensitive layer 12 can produce a sufficient effect. The photosensitive layer 12 of the electrophotographic photosensitive member 10 preferably has a thickness of 5 μm or more and 100 μm or less, and more preferably 10 μm or more and 50 μm or less, for example.

Next, an example of a method for producing the electrophotographic photosensitive member 10 will be described. For forming the electrophotographic photosensitive member 10 of the present disclosure, the naphthalenediimide derivative, a charge generating material, a hole transport material, a binder resin, and one or more optional additives are dissolved or dispersed in a solvent to give an application liquid. The application liquid is applied to the conductive substrate 11 by an appropriate application method, and then the liquid applied is dried. Thus, the electrophotographic photosensitive member 10 can be produced. The application method is not particularly limited, and examples thereof include dip coating.

The solvent to be used in the application liquid is not particularly limited as long as the components can be dissolved or dispersed therein. Examples of the solvent include alcohols (specifically, methanol, ethanol, isopropanol, or butanol), aliphatic hydrocarbons (specifically, n-hexane, octane, or cyclohexane), aromatic hydrocarbons (specifically, benzene, toluene, or xylene), halogenated hydrocarbons (specifically, dichloromethane, dichloroethane, carbon tetrachloride, or chlorobenzene), ethers (specifically, dimethyl ether, diethyl ether, tetrahydrofuran, ethylene glycol dimethyl ether, or diethylene glycol dimethyl ether), ketones (specifically, acetone, methyl ethyl ketone, or cyclohexane), esters (specifically, ethyl acetate, or methyl acetate), dimethyl formaldehyde, dimethyl formamide, and dimethyl sulfoxide. These solvents may be used independently, or two or more of the solvents may be used in combination.

The electrophotographic photosensitive member 10 as described above is used as an image bearing member in an electrographic image forming apparatus, for example. Including the electrophotographic photosensitive member 10 as an image bearing member, the image forming apparatus can form high-quality images. Furthermore, damages that may be caused to the photosensitive layer 12 of the electrophotographic photosensitive member 10 can be reduced.

EXAMPLES

Hereinafter, the present disclosure will be described in more detail by way of examples. The present disclosure is in no way limited to the examples.

[Synthesis of Naphthalenediimide Derivative]

Synthesis Example 1

A naphthalenediimide derivative represented by the formula (1-2) was synthesized in accordance with the following scheme 3.

[Electron Transport Material (ETM-1)]

1-2

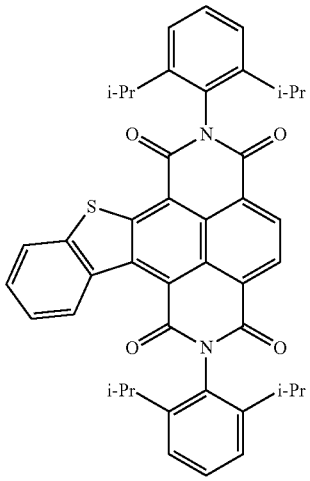

Mol. Wt.: 692.9

[Scheme 3]

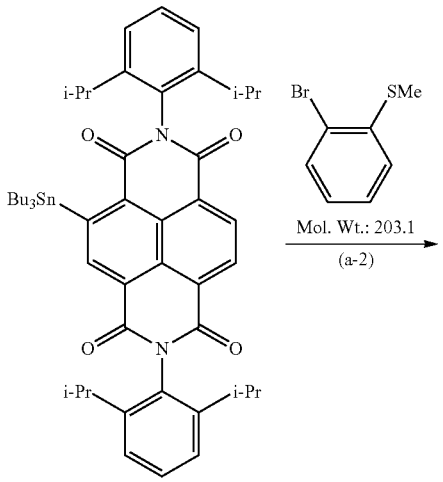

Mol. Wt.: 875.8
A-12

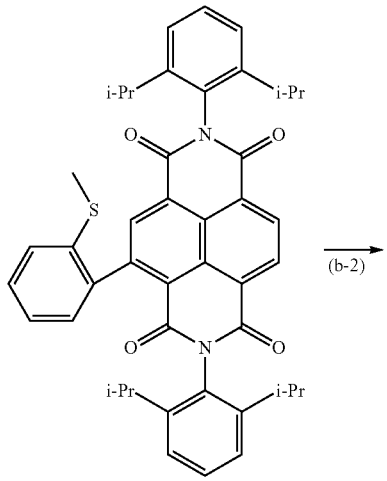

Mol. Wt.: 708.9
A-22

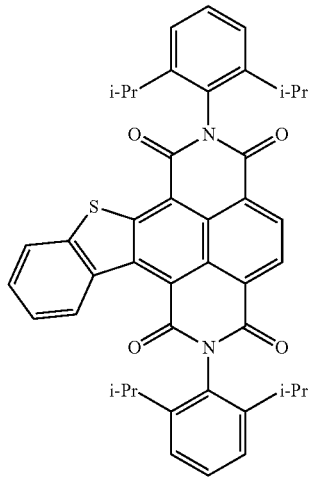

Mol. Wt.: 692.9
1-2

In (a-2) of the scheme 3, a toluene solution of 0.875 g (1 mmol) of a compound (A-12), 0.812 g (4 mmol) of 2-bromothioanisole, 58 mg (0.05 mmol) of tetrakis(triphenylphosphine)palladium, and 19 mg (0.1 mmol) of copper iodide was stirred under reflux under a nitrogen atmosphere at 110° C. for 10 hours to give a reaction solution.

The toluene as a solvent in the reaction solution was evaporated, and the resulting residue was purified by column chromatography to give 0.6 g of a compound (A-22) (yield: 85%).

In (b-2) of the scheme 3, a solution obtained by mixing 0.708 g (1 mmol) of the compound (A-22), 10 ml of acetic acid, and 10 ml of chloroform was cooled with ice. Then, 230 mg of a 30% aqueous hydrogen peroxide solution was added thereto, and the solution mixture was stirred at room temperature for 10 hours to give a reaction solution.

The reaction solution was added to methanol to give a solid-containing methanol mixture. The solid-containing methanol mixture was filtered to collect a solid. Then, 145 mg of the solid collected, 6 mg (0.04 mmol) of phosphorous pentoxide, and 4.5 ml of trifluoromethanesulfonic acid were stirred together at room temperature for 72 hours and cooled in ice water.

The resulting solid-containing mixture was filtered to collect a solid, and the solid was refluxed in pyridine for 12 hours. Thereafter, 138 mg of the compound (1-2) was obtained through extraction with chloroform and water, and purification by column chromatography (yield: 20%). $^1$H-NMR spectral data of the compound (1-2) is as follows. $^1$H-NMR: δ=8.92-8.93 (d, 1H), 8.87-8.89 (t, 1H), 8.62 (s, 1H), 7.52-7.55 (t, 1H), 7.42-7.46 (t, 1H), 7.39-7.40 (t, 1H), 7.38-7.39 (t, 1H), 7.37-7.38 (m, 1H), 7.34-7.35 (d, 1H), 7.28-7.30 (m, 2H), 7.26-7.27 (d, 1H), 7.16-7.17 (d, 1H), 2.76-2.82 (m, 2H), 2.70-2.75 (m, 1H), 2.64-2.68 (m, 1H), 2.33 (s, 3H), 1.13-1.17 (m, 18H), 1.07-1.08 (d, 3H), 1.01-1.02 (d, 3H)

The $^1$H-NMR spectral data was obtained through a measurement using a 600 MHz proton nuclear magnetic resonance ($^1$H-NMR) spectrometer. $CD_2Cl_2$ was used as a solvent, and tetramethylsilane (TMS) was used as a reference material.

Synthesis Example 2

A naphthalenediimide derivative represented by the following formula (1-3) was synthesized in accordance with the following scheme 4.

[Electron transport material (ETM-2)]

1-3

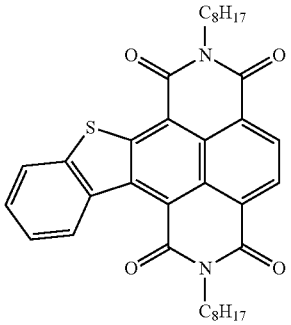

Mol. Wt.: 596.8

[Scheme 4]

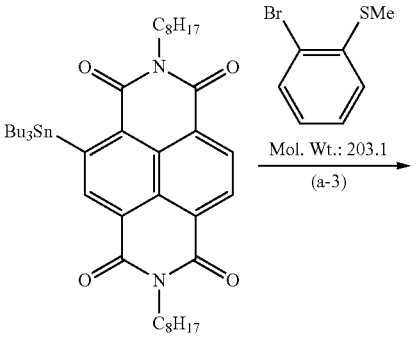

Mol. Wt.: 779.7
A-13

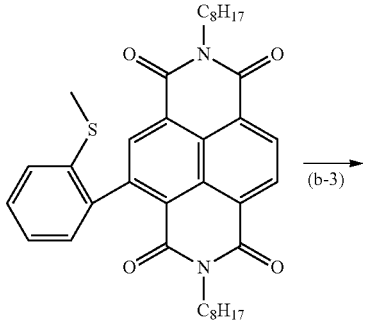

Mol. Wt.: 612.8
A-23

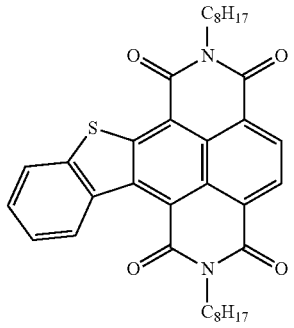

Mol. Wt.: 596.8
1-3

In (a-3) of the scheme 4, a toluene solution of 0.78 g (1 mmol) of a compound (A-13), 0.81 g (4 mmol) of 2-bromothioanisole, 58 mg (0.05 mmol) of tetrakis(triphenylphosphine)palladium, and 19 mg (0.1 mmol) of copper iodide was stirred under reflux under a nitrogen atmosphere at 110° C. for 10 hours to give a reaction solution.

The toluene as a solvent in the reaction solution was evaporated, and the resulting residue was purified by column chromatography to give 0.49 g of a compound (A-23) (yield: 80%).

In (b-3) of the scheme 4, a solution obtained by mixing 0.61 g (1 mmol) of the compound (A-23), 10 ml of acetic acid, and 10 ml of chloroform was cooled with ice. Then, 230 mg of a 30% aqueous hydrogen peroxide solution was added thereto, and the solution mixture was stirred at room temperature for 10 hours to give a reaction solution.

The reaction solution was added to methanol to give a solid-containing methanol mixture. The solid-containing mixture was filtered to collect a solid. Then, 145 mg of the solid collected, 6 mg (0.04 mmol) of phosphorous pentoxide, and 4.5 ml of trifluoromethanesulfonic acid were stirred together at room temperature for 72 hours and cooled in ice water.

The resulting solid-containing mixture was filtered to collect a solid, and the solid was refluxed in pyridine for 12 hours. Thereafter, 60 mg of the compound (1-3) was obtained through extraction with chloroform and water, and purification by column chromatography (yield: 10%)

Synthesis Example 3

A naphthalenediimide derivative represented by the following formula (1-4) was synthesized in accordance with the following scheme 5.

[Electron transport material (ETM-3)]

1-4

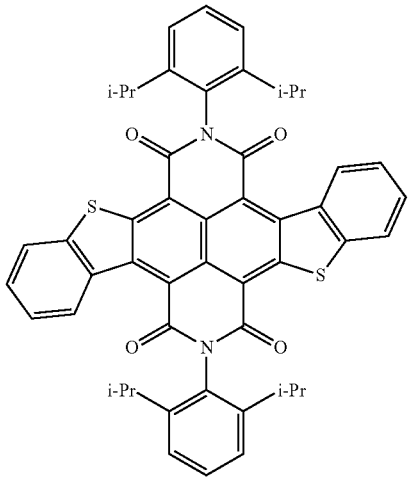

Mol. Wt.: 799

[Scheme 5]

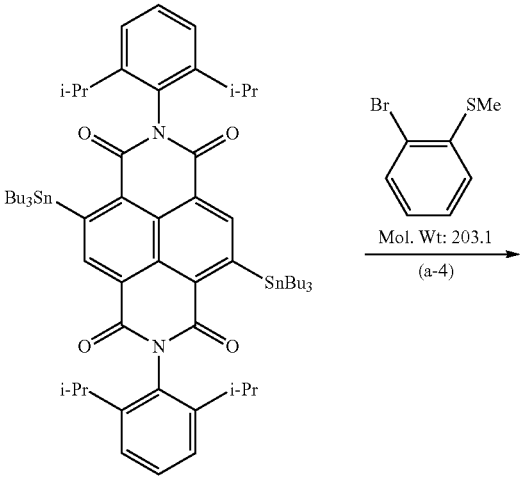

Mol. Wt: 1164.8
A-14

-continued

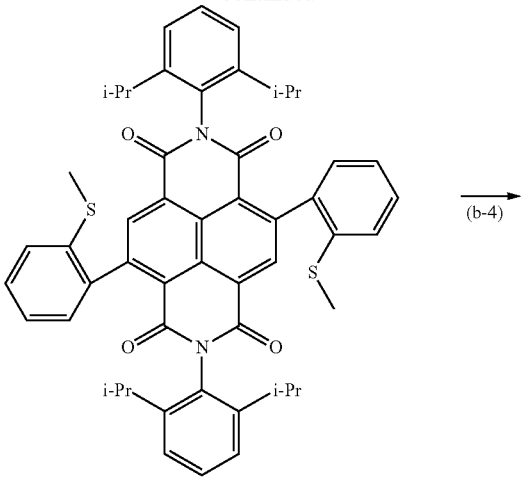

Mol. Wt: 831.1
A-24

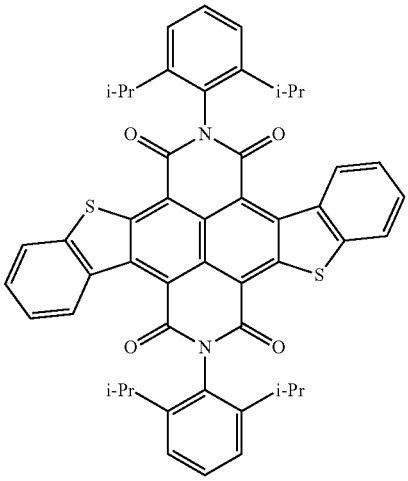

Mol. Wt: 799
1-4

In (a-4) of the scheme 5, a toluene solution of 1.17 g (1 mmol) of a compound (A-14), 1.62 g (4 mmol) of 2-bromothioanisole, 58 mg (0.05 mmol) of tetrakis(triphenylphosphine)palladium, and 19 mg (0.1 mmol) of copper iodide was stirred under reflux under a nitrogen atmosphere at 110° C. for 10 hours to give a reaction solution.

The toluene as a solvent in the reaction solution was evaporated, and the resulting residue was purified by column chromatography to give 0.66 g of a compound (A-24) (yield: 80%).

In (b-4) of the scheme 5, a solution obtained by mixing 0.83 g of the compound (A-24), 10 ml of acetic acid, and 10 ml of chloroform was cooled with ice. Then, 454 mg of a 30% aqueous hydrogen peroxide solution was added thereto, and the solution mixture was stirred at room temperature for 10 hours to give a reaction solution.

Methanol was added to the reaction solution to give a solid-containing mixture. The solid-containing mixture was filtered to collect a solid. Then, 145 mg of the solid collected, 6 mg (0.04 mmol) of phosphorous pentoxide, and 4.5 ml of trifluoromethanesulfonic acid were stirred together at room temperature for 72 hours and cooled in ice water.

The resulting solid-containing mixture was filtered to collect a solid, and the solid was refluxed in pyridine for 12 hours. Thereafter, 80 mg of the compound (1-4) was obtained through extraction with chloroform and water, and purification by column chromatography (yield: 10%)

Synthesis Example 4

A naphthalenediimide derivative represented by the following formula (1-5) was synthesized in accordance with the following scheme 6.

[Electron transport material (ETM-4)]

1-5

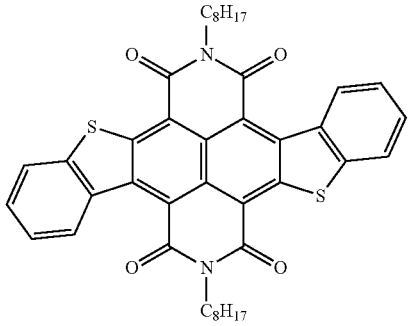

Mol. Wt.: 702.9

[Scheme 6]

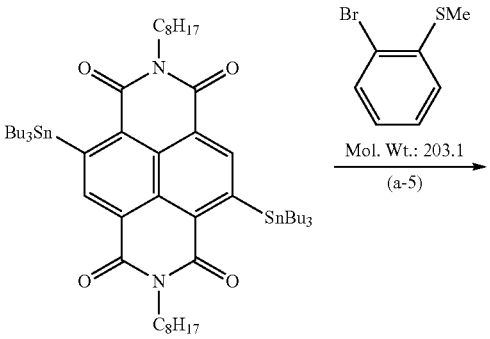

Mol. Wt.: 1068.7
A-15

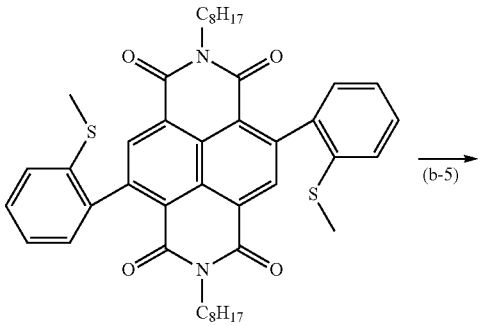

Mol. Wt.: 735
A-25

-continued

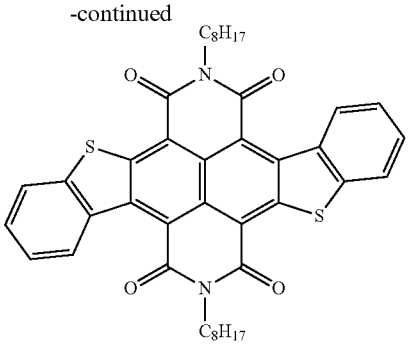

Mol. Wt.: 702.9
1-5

In (a-5) of the scheme 6, a toluene solution of 1.07 g (1 mmol) of a compound (A-15), 1.62 g (4 mmol) of 2-bromothioanisole, 58 mg (0.05 mmol) of tetrakis(triphenylphosphine)palladium, and 19 mg (0.1 mmol) of copper iodide was stirred under reflux under a nitrogen atmosphere at 110° C. for 10 hours to give a reaction solution.

The toluene as a solvent in the reaction solution was evaporated, and the resulting residue was purified by column chromatography to give 0.59 g of a compound (A-25) (yield: 80%).

In (b-5) of the scheme 6, a solution obtained by mixing 0.83 g of the compound (A-25), 10 ml of acetic acid, and 10 ml of chloroform was cooled with ice. Then, 454 mg of a 30% aqueous hydrogen peroxide solution was added thereto, and the solution mixture was stirred at room temperature for 10 hours to give a reaction solution.

Methanol was added to the reaction solution to give a solid-containing mixture. The solid-containing mixture was filtered to collect a solid. Then, 145 mg of the solid collected, 6 mg (0.04 mmol) of phosphorous pentoxide, and 4.5 ml of trifluoromethanesulfonic acid were stirred together at room temperature for 72 hours and cooled in ice water.

The resulting solid-containing mixture was filtered to collect a solid, and the solid was refluxed in pyridine for 12 hours. Thereafter, 70 mg of the compound (1-5) was obtained through extraction with chloroform and water, and purification by column chromatography (yield: 10%).

Example 1

1. Production of Electrophotographic Photosensitive Member

To a vessel, 5 parts by mass of crystal form X of a metal-free phthalocyanine (x-$H_2$Pc) represented by the following formula (CGM-1) as a charge generating material, 50 parts by mass of the hole transport material represented by the following formula (HTM-1), 50 parts by mass of the electron transport material represented by the formula (1-2, ETM-1), which is the naphthalenediimide derivative synthesized in Synthesis Example 1, 100 parts by mass of a polycarbonate resin having a unit derived from bisphenol Z ("Panlite® TS-2050" manufactured by TEIJIN LIMITED), and 800 parts by mass of a solvent (tetrahydrofuran) were added. The substances were mixed and dispersed using a ball mill for 50 hours to give an application liquid for photosensitive layer formation.

Then, an aluminum substrate (support substrate) with one end up was dipped in the application liquid for photosensitive layer formation at an application rate of 5 mm/second thereby to apply the application liquid for photosensitive layer formation to the substrate. Subsequently, the application liquid applied was hot-air-dried at 100° C. for 60 minutes and thus cured to give an electrophotographic photosensitive member of Example 1. The photosensitive layer of the electrophotographic photosensitive member of Example 1 had a thickness of 30 μm.

[Charge Generating Material]

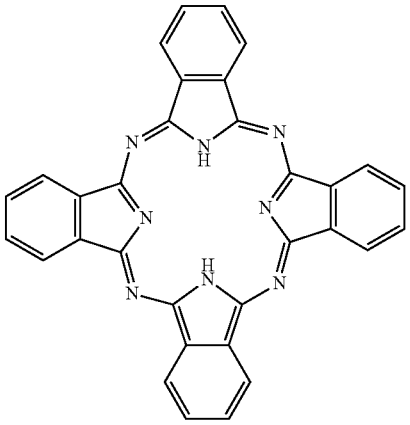

CGM-1

[Hole Transport Material]

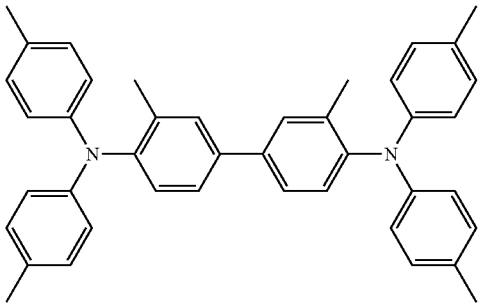

HTM-1

Example 2

An electrophotographic photosensitive member of Example 2 was obtained in the same manner as in Example 1 except that instead of the X—$H_2$Pc represented by the formula (CGM-1), the same amount of a Y-form titanyl phthalocyanine (Y—TiOPc) represented by the formula (CGM-2) was used as a charge generating material.

[Charge Generating Material]

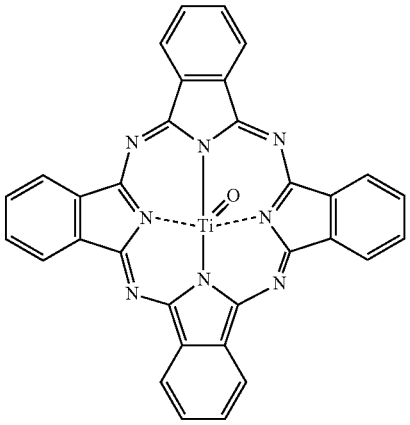

CGM-2

Example 3

An electrophotographic photosensitive member of Example 3 was obtained in the same manner as in Example 1 except that instead of the naphthalenediimide derivative represented by the formula (1-2, ETM-1), the same amount of the naphthalenediimide derivative represented by the formula (1-3, ETM-2) obtained in Synthesis Example 2 was used as an electron transport material.

Example 4

An electrophotographic photosensitive member of Example 4 was obtained in the same manner as in Example 1 except that instead of the X—$H_2$Pc represented by the formula (CGM-1), the same amount of the Y-form titanyl phthalocyanine (Y—TiOPc) represented by the formula (CGM-2) was used as a charge generating material, and that instead of the naphthalenediimide derivative represented by the formula (1-2, ETM-1), the same amount of the naphthalenediimide derivative represented by the formula (1-3, ETM-2) obtained in Synthesis Example 2 was used as an electron transport material.

Example 5

An electrophotographic photosensitive member of Example 5 was obtained in the same manner as in Example 1 except that instead of the naphthalenediimide derivative represented by the formula (1-2, ETM-1), the same amount of the naphthalenediimide derivative represented by the formula (1-4, ETM-3) obtained in Synthesis Example 3 was used as an electron transport material.

Example 6

An electrophotographic photosensitive member of Example 6 was obtained in the same manner as in Example 1 except that instead of the X—$H_2$Pc represented by the formula (CGM-1), the same amount of the Y-form titanyl phthalocyanine (Y—TiOPc) represented by the formula (CGM-2) was used as a charge generating material, and that instead of the naphthalenediimide derivative represented by the formula (1-2, ETM-1), the same amount of the naphthalenediimide derivative represented by the formula (1-4, ETM-3) obtained in Synthesis Example 3 was used as an electron transport material.

Example 7

An electrophotographic photosensitive member of Example 7 was obtained in the same manner as in Example 1 except that instead of the naphthalenediimide derivative represented by the formula (1-2, ETM-1), the same amount of the naphthalenediimide derivative represented by the formula (1-5, ETM-4) obtained in Synthesis Example 4 was used as an electron transport material.

Example 8

An electrophotographic photosensitive member of Example 8 was obtained in the same manner as in Example 1 except that instead of the X—$H_2$Pc represented by the formula (CGM-1), the same amount of the Y-form titanyl phthalocyanine (Y—TiOPc) represented by the formula (CGM-2) was used as a charge generating material, and that instead of the naphthalenediimide derivative represented by the formula (1-2, ETM-1), the same amount of the naphthalenediimide derivative represented by the formula (1-5, ETM-4) obtained in Synthesis Example 4 was used as an electron transport material.

Comparative Example 1

An electrophotographic photosensitive member of Comparative Example 1 was obtained in the same manner as in Example 1 except that instead of the naphthalenediimide derivative represented by the formula (1-2, ETM-1), the same amount of a naphthalenediimide derivative represented by the following formula (1-6, ETM-5) was used as an electron transport material.

1-6

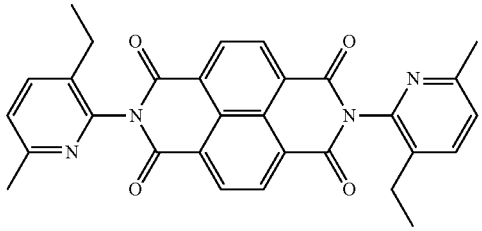

ETM-5

Comparative Example 2

An electrophotographic photosensitive member of Comparative Example 2 was obtained in the same manner as in Example 1 except that instead of the X—$H_2$Pc represented by the formula (CGM-1), the same amount of the Y-form titanyl phthalocyanine (Y—TiOPc) represented by the formula (CGM-2) was used as a charge generating material, and that instead of the naphthalenediimide derivative represented by the formula (1-2, ETM-1), the same amount of the naphthalenediimide derivative represented by the formula (1-6, ETM-5) was used as an electron transport material.

2. Evaluation of Electrophotographic Photosensitive Members

<Evaluation of Photosensitivity>

The photosensitivity was evaluated for the electrophotographic photosensitive members obtained in each of the examples and the comparative examples. Each electrophotographic photosensitive member obtained was charged to 700 V using a drum sensitivity test device (manufactured by Gentec Inc.), and then irradiated with monochromatic light having a wavelength of 780 nm (half-width: 20 nm, light amount: 16 μW/$cm^2$) extracted by allowing light emitted from a halogen lamp to pass through a bandpass filter (irradiation time: 80 milliseconds). The surface potential (residual potential) was measured after a lapse of 330 milliseconds from the initiation of the irradiation. The results of the evaluation of the photosensitivity are shown in Table 1. The photosensitive layer of each electrophotographic photosensitive member had a film thickness of 30 μm.

<Evaluation of Crystallization>

The occurrence of crystallization on the surface of the electrophotographic photosensitive member obtained in each of the examples and the comparative examples was observed. Specifically, the presence or absence of crystals on the surface of each electrophotographic photosensitive member was observed using an optical microscope. The results of the evaluation are shown in Table 1.

Table 1 collectively shows the results of the evaluations on the respective electrophotographic photosensitive members obtained in the examples and the comparative examples.

TABLE 1

| | CGM | HTM | ETM | Photo-sensitivity (V) | Drum Appearance (Crystallization) |
|---|---|---|---|---|---|
| Example 1 | CGM-1 | HTM-1 | ETM-1 | 107 | No |
| Example 2 | CGM-2 | HTM-1 | ETM-1 | 102 | No |
| Example 3 | CGM-1 | HTM-1 | ETM-2 | 108 | No |
| Example 4 | CGM-2 | HTM-1 | ETM-2 | 103 | No |
| Example 5 | CGM-1 | HTM-1 | ETM-3 | 101 | No |
| Example 6 | CGM-2 | HTM-1 | ETM-3 | 97 | No |
| Example 7 | CGM-1 | HTM-1 | ETM-4 | 103 | No |
| Example 8 | CGM-2 | HTM-1 | ETM-4 | 99 | No |
| Comparative Example 1 | CGM-1 | HTM-1 | ETM-5 | 135 | Yes |
| Comparative Example 2 | CGM-2 | HTM-1 | ETM-5 | 130 | Yes |

As obvious from Table 1, the electrophotographic photosensitive members obtained in Examples 1 to 8 had excellent photosensitivity since they each contained the specified naphthalenediimide derivative, and the naphthalenediimide derivative was homogeneously dispersed in the photosensitive layer, preventing the crystallization in the photosensitive layer.

The electrophotographic photosensitive members obtained in Comparative Examples 1 and 2 did not contain the specified naphthalenediimide derivative, and therefore the crystallization in the photosensitive layer was not prevented. Since some crystallization occurred, the electrophotographic photosensitive members had poor photosensitivity.

What is claimed is:

1. An electrophotographic photosensitive member comprising a conductive substrate and a photosensitive layer wherein the photosensitive layer contains a charge generating material and a naphthalenediimide derivative represented by the following formula (1) or (2):

(1)

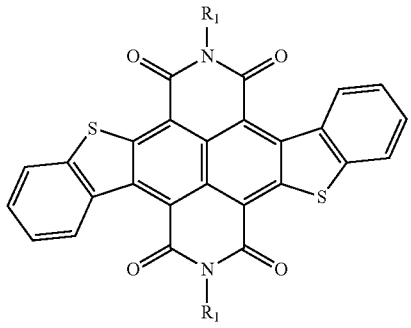

-continued (2)

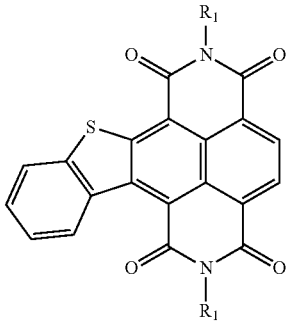

wherein $R_1$ represents an alkyl group having 1 to 10 carbon atoms, an aryl group having 6 to 12 carbon atoms and optionally having an alkyl group having 1 to 10 carbon atoms, an aralkyl group having 7 to 12 carbon atoms, a cycloalkyl group having 3 to 10 carbon atoms, or an alkoxy group having 1 to 6 carbon atoms.

2. An electrophotographic photosensitive member according to claim 1, wherein the photosensitive layer contains the charge generating material, a hole transport material, an electron transport material, and a binder resin in a single layer, and the electron transport material contains the naphthalenediimide derivative represented by the formula (1) or (2).

3. An electrophotographic photosensitive member according to claim 1, wherein $R_1$ is an alkyl group having 1 to 10 carbon atoms or an aryl group having 6 to 12 carbon atoms and optionally having an alkyl group having 1 to 10 carbon atoms in the formula (1) or (2).

4. An electrophotographic photosensitive member according to claim 1, wherein $R_1$ is an octyl group or a diisopropylphenyl group in the formula (1) or (2).

5. An electrophotographic photosensitive member according to claim 1 comprising a photosensitive layer containing the naphthalenediimide derivative represented by the formula (1), wherein $R_1$ is an octyl group or a diisopropylphenyl group.

* * * * *